United States Patent [19]

Ihara et al.

[11] Patent Number: 4,495,089

[45] Date of Patent: Jan. 22, 1985

[54] CONTINUOUS PROCESS FOR THE PRODUCTION OF SOLVENTS FOR COAL LIQUEFACTION

[75] Inventors: Hiroyuki Ihara; Kazuo Takahashi; Michiro Matsubara; Fumio Kumata; Yoshitomo Sanami, all of Kanagawa, Japan

[73] Assignee: Mitsubishi Oil Company, Limited, Tokyo, Japan

[21] Appl. No.: 416,763

[22] Filed: Sep. 10, 1982

[30] Foreign Application Priority Data

Sep. 12, 1981 [JP] Japan ..... 56-143183

[51] Int. Cl.[3] ..... B01F 1/00; C10G 1/08

[52] U.S. Cl. ..... 252/364; 585/269; 585/270; 208/8 LE

[58] Field of Search ..... 585/269, 270; 252/364; 208/8 LE

[56] References Cited

U.S. PATENT DOCUMENTS 3,761,397 9/1973 Gatti ..... 585/270
4,133,646 1/1979 Farcasiu ..... 44/1 R
4,312,746 1/1982 Tsai ..... 208/8 LE

FOREIGN PATENT DOCUMENTS 462478 3/1937 United Kingdom ..... 208/10 LE
484334 11/1937 United Kingdom ..... 252/364

*Primary Examiner*—Richard D. Lovering
*Assistant Examiner*—Anne Brookes
*Attorney, Agent, or Firm*—Sughrue, Mion, Zinn, Macpeak, and Seas

[57] ABSTRACT

A continuous process for the production of a solvent for use in the liquefaction of coal is described. The process comprises hydrogenating a mixture of 100 parts by weight of a hydrocarbon mixture and from 0.2 to 10 parts by weight of phenol and/or alkylphenol. The hydrocarbon mixture contains at least 50% by weight of a polycyclic (from tricyclic to pentacyclic) aromatic hydrocarbon or its alkyl derivative. The hydrocarbon mixture is distilled away in a proportion of at least 80% when heated at a temperature of from 320° to 550° C. The hydrogenation of the hydrocarbon mixture and phenol and/or alkylphenol may be carried out with or without the addition of from 0.05 to 0.5% by weight (calculated as sulfur) of an easily desulfurizable sulfur compound in a high temperature and pressure hydrogen atmosphere in the presence of a catalyst containing the sulfide(s) of Group VIII metal and/or Group VI metal of the Periodic Table to prepare a partially hydrogenated product resulting from the partial hydrogenation of the aromatic ring of the polycyclic aromatic hydrocarbon or its alkyl derivative.

10 Claims, No Drawings

CONTINUOUS PROCESS FOR THE PRODUCTION OF SOLVENTS FOR COAL LIQUEFACTION

FIELD OF THE INVENTION

The present invention relates to a continuous process for the production of solvents for coal liquefaction.

BACKGROUND OF THE INVENTION

Various methods have been proposed for the liquefaction of coal, including a dry distallation process in which coal is heated at high temperatures and the thus-distilled tar component is recovered, a solvent extraction process in which coal is extracted with a solvent, an extraction-chemical decomposition process (for example, EDS Process) in which decomposition of coal is achieved using a hydrogen-donating solvent simultaneously with its extraction, an extraction-hydrogenation process (for example, SRC Process) in which solvent extraction is performed while supplying hydrogen gas under high pressure, and a direct hydrogenation process (for example, H-Coal Process) in which hydrogenolysis of coal is performed in the presence of a catalystic while supplying hydrogen gas under high pressure.

The dry distillation process is not desirable because the liquefaction yield is low with respect to ordinary coal although the process is simplified. In the solvent extraction process, benzene, toluene, xylene, carbolic acid, cresol, methylnaphthalene, creosote oil, anthracene oil, etc., are used to achieve the solvent extraction of coal. This process is not desirable because the extraction efficiency, i.e., liquefaction yield, is poor and it is, therefore, necessary to lengthen the extraction time.

In accordance with the extraction-chemical decomposition process, a hydrogen-donating solvent, such as tetralin, a mixture of tetralin and cresol, hydrogenated creosote oil, and hydrogenated anthracene, is added to coal and heated at about 400° to 480° C. to achieve the extraction-decomposition of coal. This process is advantageous in that the liquefaction yield is good and the reaction time is short. In using a mixture of tetralin and cresol, however, a problem arises in that when the mixture is heated at 400° to 480° C., high pressure is developed because both tetralin and cresol have boiling points of about 200° C. Also, in the case of hydrogenated creosote oil, hydrogenated anthracene oil, etc., high pressure is developed during the liquefaction reaction because their volatile component contents are high. Furthermore, in hydrogenating creosote oil or anthracene oil to prepare the hydrogenated creosote oil or anthracene oil, the hydrogenation reaction proceeds excessively and, therefore, it is difficult to perform the reaction continuously.

As is well known in the art, such hydrogenated oils have been produced batchwise using a device such as an autoclave. That is, a nickel-molybdenum catalyst is used in an amount of from 5 to 10% by weight based on the free oil, and hydrogenation is carried out at a temperature of from 380° to 450° C. and a pressure of from 100 to 200 kg/cm$^2$ (gauge pressure) for a period of from 2 to 4 hours. However, hydrogenation using a continuous flow type fixed bed reactor under conditions comparable to the above-described batchwise reaction conditions is very difficult in view of liquid space velocity. Even when hydrogenation is carried out under similar conditions, i.e., the same reaction temperature and reaction pressure, a substantial amount of deposition of carbon occurs in the catalyst layer.

When the feedstock for the production of the coal liquefaction solvent of the invention (i.e., a hydrocarbon mixture from which an 80% by weight or more portion is distilled away then heated at a temperature of from 320° to 550° C.) is hydrogenated without the addition of phenol and/or alkylphenols, the hydrogenation reaction proceeds either excessively or insufficiently. This will be hereinafter explained in detail by reference to the hydrogenation of pyrene which is a tetracyclic aromatic hydrocarbon as one of the major components contained in the feedstock. In the hydrogenation of pyrene, it is considered that partially hydrogenated products, such as dihydro-, tetrahydro-, hexahydro-, octahydro-, and decahydro-pyrenes, and a completely hydrogenated product, i.e., perhydropyrene, are produced. It is, however, difficult to obtain efficiently hydrogenated products having a partial hydrogenation rate of less than 50%, i.e., dihydro-, tetrahydro-, and hexahydro-pyrenes, since the hydrogenation reaction successively proceeds, forming partially hydrogenated products having a partial hydrogenation rate of 50% or more, e.g., octahydro- and decahydro-pyrenes, perhydro-pyrene, and mixtures thereof. These partially hydrogenated products having a partial hydrogenation rate of 50% or more have poor hydrogen-donating properties and their coal-dissolving powers are also poor. Therefore, they are not suitable for use as solvents for the liquefaction of coal according to the extraction-chemical decomposition process.

In brief, in the hydrogenation of a hydrocarbon mixture from which an 80% by weight or more portion is distilled away on heating at a temperature of from 320° to 550° C., and which is to be used as a feed for the production of a solvent for coal liquefaction as described hereinafter, the amount of hydrogen consumed is large and the liquefaction efficiency of producing partially hydrogenated products is poor. This results in the formation of large amounts of partially hydrogenated products having a partial hydrogenation rate of 50% or more. In the coal liquefaction technology, therefore, it is very desirable from an economic standpoint to reduce or control the formation of such highly hydrogenated products. Many difficulties, however, are encountered in attaining this object by conventional methods.

Both the extraction-hydrogenation process and the direct hydrogenation process are disadvantageous in that a large amount of hydrogen is needed. Particularly, in the case of the latter process, a catalyst which can be used over a long period of time has not yet been developed. Thus, many problems arise in the commercial practice of the processes.

SUMMARY OF THE INVENTION

A primary object of the present invention is to provide a continuous process for the production of solvents for use in coal liquefaction according to an extraction-chemical decomposition process.

In accordance with the process of the present invention, the total amount of hydrogen consumed in the liquefaction of coal is low and the pressure at which the liquefaction reaction is performed is low and, therefore, the amount of energy consumed can be reduced.

The present invention, therefore, relates to a continuous process for the production of a solvent for use in coal liquefaction. The process is comprised of hydrogenating a mixture of 100 parts by weight of a hydrocarbon mixture and from 0.2 to 10 parts by weight of phenol and/or alkylphenol. The alkyl group in the alkylphenol contains from 1 to 3 carbon atoms. The hydrocarbon mixture contains at least 50% by weight of a polycyclic (from tricyclic to pentacyclic) aromatic hydrocarbon and its alkyl derivative. The hydrocarbon mixture is distilled away in a proportion of at least 80% by weight when heated at a temperature of from 320° to 550° C. The hydrogenation of hydrocarbon mixture and phenol and/or alkylphenol may be carried out with or without the addition of from 0.05 to 0.5% by weight (calculated as sulfur) of an easily desulfurizable sulfur compound in a high temperature and pressure hydrogen atmosphere in the presence of a catalyst containing the sulfide(s) of Group VIII and/or Group VI metal(s) of the Periodic Table. A partially hydrogenated product is obtained as a result of the partial hydrogenation of the aromatic ring of the polycyclic aromatic hydrocarbon or its alkyl derivative.

DETAILED DESCRIPTION OF THE INVENTION

The term "polycyclic (from tricyclic to pentacyclic) aromatic hydrocarbon and its alkyl derivative" is used herein to mean a mixture consisting of one or more compounds selected from the group consisting of phenanthrene, anthracene, fluoranthene, pyrene, chrysene, cholanthrene, benzo(a)pyrene, and their alkyl derivatives. The polycyclic aromatic compound and/or its alkyl derivative are preferably contained in the feed for the production of a solvent for coal liquefaction in an amount of at least 50% by weight based on hydrocarbon mixture feed.

The term "alkylphenol (wherein the alkyl group contains from 1 to 3 carbon atoms)" as used herein means one compound or a mixture of two or more selected from the group consisting of cresols, xylenols, methylethylphenols, and propylphenols, the boiling point of each compound being within the range of from 180° to 250° C. In addition, it includes a product obtained by the condensation of the above-described alkylphenols by techniques such as alkali extraction and distillation.

Preferred examples of catalysts containing one or more sulfide(s) of the metal(s) selected from the Groups VIII and VI of the Periodic Table are a nickel-molybdenum sulfide catalyst and a cobalt-molybdenum sulfide catalyst.

The hydrogenation reaction is carried out at a high temperature in a pressurized hydrogen atmosphere. The reaction is preferably carried out at a temperature of from 280° to 360° C., preferably 300° to 340° C., a pressure of from 50 to 200 kg/cm$^2$ (gauge pressure), preferably 100 to 150 kg/cm$^2$. The ratio of hydrogen to feed is preferably from 300 to 3,000 (vol/vol), preferably 500 to 1,000, and the liquid space velocity per hour is preferably from 0.5 to 2.0 (vol/vol).

The partially hydrogenated product of the invention is an aromatic ring-partially hydrogenated product having a partial hydrogenation rate of less than 50%, in which less than one-half of the amount of hydrogen required for the complete hydrogenation is used for the partial hydrogenation. This partially hydrogenated product has an excellent ability to dissolve coal and furthermore has excellent hydrogen-donating properties. Thus, it is very suitable for use as a solvent for coal liquefaction.

When the partially hydrogenated product having a partial hydrogenation rate of less than 50% of the invention is used in the liquefaction of coal in accordance with the extraction-chemical decomposition process, it efficiently supplies the minimum amount of hydrogen required for the liquefaction of coal. From a liquid product resulting from the coal liquefaction is recovered a solvent raw material which can be used to prepare the partially hydrogenated product-containing solvent for the coal liquefaction according to the process of the invention.

The gist of the invention resides in that a hydrocarbon mixture composed mainly of polycyclic (from tricyclic to pentacyclic) aromatic hydrocarbons and their alkyl derivatives and having a boiling point range of from 320° to 550° C. is mixed with a trace amount of or small amount of phenol and/or alkylphenol having a boiling point range of from 180° to 250° C. and partially hydrogenated in the presence of a nickel-molybdenum sulfide catalyst and/or a cobalt-molybdenum sulfide catalyst, whereby a partially hydrogenated product having a partial hydrogenation rate of less than 50%, resulting from the partial hydrogenation of aromatic ring, can be obtained in high yields and at a low hydrogen consumption rate.

Although the exact reason why the hydrogenation reaction proceeds selectivity when phenol and/or alkylphenol is added to polycyclic aromatic hydrocarbons is not clear, it is believed that:

Polycyclic aromatic hydrocarbons have a low hydrogen content and a high polarity as compared with saturated hydrocarbons. It is, therefore, considered that the hydrocarbons easily contact with the active sites of the catalyst at initial stages of the hydrogenation reaction. However, as the partial hydrogenation proceeds, the polarity is weakened, and when there are phenol and/or alkylphenols in the reaction system, the hydrocarbons compete with such phenol and/or alkylphenols in contacting with the active sites of the catalyst. Thus, when the hydrogenation proceeds to a certain extent, further hydrogenation is retarded.

It has been observed that the presence of such phenol and/or alkylphenols is very effective in the partial hydrogenation of fluoranthene, pyrene, and chrysene which are tetracyclic aromatic hydrocarbons.

When a coal-derived solvent having a broad boiling point range of from 200° to 450° C., i.e., falling outside the scope of the invention, is used, the above-described selective hydrogenation effect can be expected since the solvent generally contains small amounts of light alkylphenols. The use of such coal-derived solvents, however, suffers from disadvantages in that a large amount of hydrogen is consumed in the hydrogenation of the rings of dicyclic aromatic hydrocarbons, such as naphthalene, methylnaphthalene, acenaphthene, and fluorene, contained in a light fraction having a boiling point range of from 200° to 320° C.; solvents containing hydrogen in an amount more than necessary for the liquefaction of coal are formed, and the hydrogen efficiency is poor; when the resulting solvents are used in the liquefaction of coal, high pressure is developed in the extraction-chemical decomposition process; and in that the rate of coal liquefaction is low. In the case of a heavy fraction having a boiling point of 550° C. or more, deposition of carbon in the catalyst layer for hydrogenation undesirably occurs.

It has been found that the addition of from 0.05 to 0.5% by weight (calculated as sulfur) for an easily desulfurizable sulfur compound, such as carbon disulfuide, mercaptan, alkylsulfides, and alkyldisulfides, to the partial hydrogenation feed keeps the sulfurized state of the catalyst constant, reducing changes in its activity, which permits smooth continuous production of a solvent for the liquefaction of coal.

Partial hydrogenation under the conditions that the reaction temperature is from 280° to 360° C., the reaction pressure is from 50 to 200 kg/cm$^2$ (gauge pressure), the hydrogen/feed ratio is from 300 to 3,000 (vol/vol), and the liquid space velocity per hour is from 0.5 to 2.0 (vol/vol) produces hydrogenated products having a partial hydrogenation of less than 50%, which have excellent hydrogen-donating properties. When the severity of hydrogenation is lower than the above-defined ranges, i.e., hydrogenation is performed at lower temperatures, lower pressures, lower hydrogen/feed ratios, and higher liquid space velocities per hour, it proceeds insufficiently. On the other hand, at high severity, the hydrogenation reaction excessively proceeds, increasing the formation of partially hydrogenated products having a partial hydrogenation rate of more than 50%. Thus, the resulting solvents are reduced in the hydrogen-donating properties and the coal-dissolving ability. In addition, the carbon deposition in the catalyst layer is increased and the life of the catalyst is shortened.

The following examples are given to illustrate the invention in greater detail. However, this invention is not limited to these examples.

EXAMPLE 1 and COMPARATIVE EXAMPLE 1

The feed and its composition, hydrogenation conditions, hydrogenated products, etc., for each of Example 1 and Comparative Example 1 are shown in Table 1.

It can be seen from Table 1 that in accordance with the process of the invention, the amount of hydrogen consumed is reduced and furthermore, in the extraction-chemical decomposition reaction, the liquefaction pressure is controlled to a low level and the liquefaction yield is very high.

EXAMPLES 2 to 3 AND COMPARATIVE EXAMPLE 2

The feed and its composition, hydrogenation conditions, hydrogenated products, etc., for each of Examples 2 to 3 and Comparative Example 2 are shown in Table 2.

It can be seen from Table 2 that in the partial hydrogenation of a hydrocarbon mixture containing 64% by weight of polycyclic (tricyclic to pentacyclic) aromatic hydrocarbons in the presence of a cobalt-molybdenum sulfide catalyst to prepare solvents for coal liquefaction, if the reaction temperature is 330° C. or 360° C., the resulting partially hydrogenated oil exhibits good extraction-chemical decomposition capability, but if the reaction temperature is 390° C., substantial deposition of carbon in the catalyst layer occurs, causing plugging and furthermore, increasing the amount of hydrogen consumed and lowering the liquefaction yield.

EXAMPLES 4 TO 5 COMPARATIVE EXAMPLE 3

The feed and its composition, hydrogenation conditions, hydrogenated products, etc., for each of Examples 4 and 5, and Comparative Example 3 are shown in Table 3.

It can be seen from Table 3 that in the partial hydrogenation of pyrene in the presence of a nickel-molybdenum sulfide cataylst, the addition of alkylphenol (alkyl group: $C_1$ to $C_3$) accelerates the formation of dihydro- and tetrahydro-compounds and increases the liquefaction yield as determined by the extraction-chemical decomposition liquefaction test. The crystal (pyrene) precipitating temperature of the feed mixture with alkylphenol added as used in Examples 4 and 5 is 5° to 7° C. lower than that of the feed mixture as used in Comparative Example 3 and, therefore, its handling is easy.

TABLE 1

| | Example 1 | Comparative Example 1 |
|---|---|---|
| Feed (hydrocarbon mixture) | Tar-derived oil is vacuum distilled and cut. 97.5% by weight of the oil is mixed with 2.5% by weight of cresol, etc. | Tar-derived oil is vacuum distilled and cut. |
| Main Boiling Point Range of Hydrocarbon Mixture (°C.) (10 to 90%) | 320 and 550 | 320 to 550 |
| Main Tricyclic to Pentacyclic Aromatic Hydrocarbons (wt %) | | |
| Anthracene and Phenanthrene | 15.7 | 16.0 |
| Fluoranthene | 16.7 | 17.0 |
| Pyrene | 18.2 | 18.5 |
| Chrysene | 8.3 | 8.5 |
| Cholanthrene and Benzopyrene | 3.9 | 4.0 |
| Phenol and Alkylphenols (wt %) | | |
| Phenol | 0.5 | 0 |
| Cresols | 1.0 | 0 |
| Xylenols | 1.0 | trace |
| Partially Hydrogenated Oils*1 (wt %) | | |
| Oil having a partial hydro-*2 genation rate of less than 50% | 37 | 20 |
| Oil having a partial hydro-*2 genation rate of 50% or more. | 18 | 36 |
| Others (containing unhydrogenated tricyclic to penta- | 45 | 44 |

TABLE 1-continued

| | Example 1 | Comparative Example 1 |
|---|---|---|
| cyclic aromatic hydrocarbons) | | |
| Hydrogen Consumption Ratio (based on the weight of the feed, wt %) | 2.5 | 3.5 |
| Extraction-Chemical Decomposition Liquefaction Test*3 | | |
| Liquefaction Pressure ($kg/cm^2G$) | 6 | 10 |
| Liquefaction Yield (DAF, wt %) | 87 | 75 |

Note:
*1Partial hydrogenation was performed in a small-sized continuous flow type pilot plant by the use of a nickel-molybdenum sulfide catalyst (for desulfurization of petroleum) under the conditions of a temperature of 320° C., a pressure of 150 $kg/cm^2G$ and a liquid space velocity per hour of 1.0 v/v.
*2Main tricyclic to pentacyclic aromatic hydrocarbon partially hydrogenated products were analyzed by a gas chromatography-mass spectral method.
*3Extraction-chemical decomposition liquefaction test: Finely divided coal (from U.S.A.) was placed in a 30-ml reaction tube and liquefied at 435° C. for 10 minutes and, thereafter, it was extracted with pyridine to determine the liquefaction yield by the Dry Ash Free (DAF) Base.

TABLE 2

| | Example 2 | Example 3 | Comparative Example 2 |
|---|---|---|---|
| Feed (hydrocarbon mixture) | Tar-derived oil was vacuum distilled and cut (100 wt %) | Tar-derived oil was vacuum distilled and cut (100 wt %) | Tar-derived oil was vacuum distilled and cut (100 wt %) |
| Alkylphenols | Cresol (2 wt %) | Xylenol (3 wt %) | Cresol (2 wt %) |
| Main Boiling Point Range of Hydrocarbon Mixture (°C.) | 325–520 | 325–520 | 325–520 |
| Partial Hydrogenation Temperature*1 (°C.) | 330 | 360 | 390 |
| Partially Hydrogenated Products (wt %) | | | |
| Oil having a partial hydrogenation rate of less than 50%*2 | 45 | 37 | 18 |
| Oil having a partial hydrogenation rate of 50% or more*2 | 15 | 26 | 49 |
| Others (including unhydrogenated tricyclic to pentacyclic aromatic hydrocarbons) | 40 | 37 | 33 |
| Hydrogen Consumption Rate (based on the weight of the feed, wt %) | 2.3 | 2.8 | 4.2 |
| Extraction-Chemical Decomposition Liquefaction Test*3 | | | |
| Liquefaction Pressure ($kg/cm^2G$) | 5 | 8 | 15 |
| Liquefaction Yield (DAF, wt %) | 85 | 82 | 72 |

Note:
*1Partial hydrogenation was performed in a small-sized continuous flow type pilot plant by the use of a cobalt-molybdenum sulfide catalyst (for desulfurization of petroleum) at the reaction temperature shown in Table 2, a reaction pressure of 120 $kg/cm^2G$, and a liquid space velocity per hour of 0.5 v/v.
*2Same as in Table 1.
*3Same as in Table 1.

TABLE 3

| | Example 4 | Example 5 | Comparative Example 3 |
|---|---|---|---|
| Feed (pyrene) (g) | 12.5 | 12.5 | 12.5 |
| Dilution Solvent (decalin) (g)*1 | 100 | 100 | 100 |
| $C_1$ to $C_3$ Alkylphenol (g)*2 | 1.0 | 1.0 | |
| DBDS (g)*3 | | 0.5 | |
| Partial Hydrogenation Temperature (°C.)*4 | 290 | 290 | 290 |
| Partially Hydrogenated Oils (wt %)*5 | | | |
| Dihydropyrene | 23 | 24 | 12 |
| Tetrahydropyrene | 33 | 33 | 13 |
| Hexahydropyrene | 3 | 3 | 10 |
| Subtotal oils having a partial hydrogenation rate of less than 50% (di- to hexa-hydropyrene) | 59 | 60 | 35 |
| Oils having a partial hydrogenation rate of 50% or more | 35 | 34 | 62 |
| Others (including unhydrogenated pyrene) | 6 | 6 | 3 |
| Hydrogen Consumption Rate (per pyrene) (wt %) | 2.6 | 2.6 | 3.9 |
| Extraction-Chemical Decomposition*6 | | | |

TABLE 3-continued

| | Example 4 | Example 5 | Comparative Example 3 |
|---|---|---|---|
| Liquefaction Test | | | |
| Pressure (kg/cm$^2$G) | 3 | 3 | 4 |
| Liquefaction Yield (wt %) (DAF) | 90 | 90 | 78 |

Note:
*1Since pyrene has a melting point as high as 148° C. and easily crystallizes, decalin was used as a dilution solvent.
*2A $C_1$ to $C_3$ alkylphenol mixture having a boiling point of 200–250° C. was used.
*3Ditertiary butyl disulfide
*4Partial hydrogenation was performed in a small-sized flow type pilot plant by the use of a nickel-molybdenum sulfide catalyst (for desulfurization of petroleum) at the temperature shown in Table 3, a pressure of 160 kg/cm$^2$G, and a liquid space velocity per hour of 1.2 v/v.
*5Pyrene hydrogenated products were analyzed by a gas chromatography-mass spectral method. The dilution solvent of decalin was excluded from the analytical values.
*6Extraction-chemical decomposition liquefaction test: Same as in Table 1 (decalin was removed by distillation).

While the invention has been described in detail and with reference to specific embodiments thereof, it will be apparent to one skilled in the art that various changes and modifications can be made therein without departing from the spirit and scope thereof.

We claim:

1. A continuous process for the production of a solvent used in liquefaction of coal, comprising the steps of:

hydrogenating a mixture comprised of 100 parts by weight of a hydrocarbon mixture and from 0.2 to 10 parts by weight of phenol and/or alkylphenol in which the alkyl group contains from 1 to 3 carbon atoms, the alkylphenol being at least one member selected from the group consisting of cresols, xylenols, methylethylphenols, and propylphenols which have a boiling point of from 180° to 250° C., the hydrocarbon mixture containing at least 50% by weight of a polycyclic aromatic hydrocarbon and its alkyl derivative, the polycyclic aromatic hydrocarbon and its alkyl derivative being tricyclic to pentacyclic aromatic hydrocarbons and their alkyl derivatives and being at least one member selected from the group consisting of phenanthrene, anthracene, fluoranthene, pyrene, chrysene, cholanthrene, benzo (a) phrene, and their alkyl derivatives, wherein at least 80% by weight of the hydrocarbon mixture has a boiling point in a range of from 320° to 550° C., the hydrogenation being carried out in a high temperature and pressure atmosphere in the presence of a catalyst containing a sulfide selected from the group VIII metal sulfides and group IV metal sulfides of the Periodic Table to obtain a partially hydrogenated product having a partial hydrogenation rate of less than 50% from partial hydrogenation of an aromatic ring of the polycyclic aromatic hydrocarbon or its alkyl derivative.

2. A continuous process for the production of a solvent as claimed in claim 1, wherein the catalyst containing the sulfide is selected from the group consisting of nickel-molybdenum sulfide catalyst and cobalt-molybdenum sulfide catalyst.

3. A continuous process for the production of a solvent as claimed in claim 1, wherein the hydrogenation in a high temperature and pressure hydrogen atmosphere is performed at a temperature of from 280° to 360° C., a pressure of from 50 to 200 kg/cm$^2$ (gauge pressure), a hydrogen/feed ratio of from 300 to 3,000 vol/vol, and a liquid space velocity per hour of volume of feed oil passing per volume of the catalyst of from 0.5 to 2.0 vol/vol.

4. A continuous process for the production of a solvent as claimed in claim 1, wherein the hydrogenation is carried out with the addition of 0.05 to 0.5% by weight (calculated as sulfur) of an easily desulfurizable sulfur compound.

5. A continuous process for the production of a solvent as claimed in claim 4, wherein the easily desulfurizable sulfur compound is selected from the group consisting of a carbon desulfurization compound selected from the group consisting of carbon disulfide, mercaptan, alkylsulfides, and alkyldisulfides.

6. Process according to claim 1, wherein the amount of product which has a partial hydrogenated rate of less than 50% is more than the amount of product which has a partial hydrogenation rate of more than 50%.

7. Process according to claim 6, wherein at least 37% of the product has partial hydrogenation rate of less than 50%.

8. Process according to claim 1, wherein at least 37% of the product has a partial hydrogenation rate of less than 50%.

9. Process according to claim 8, wherein about 45% to 60% of the product has a partial hydrogenation rate of less than 50%.

10. A continuous process for the production of a solvent used in liquefaction of coal, comprising the steps of:

hydrogenating a mixture comprised of 100 parts by weight of a hydrocarbon mixture and from 0.2 to 10 parts by weight of phenol and/or alkylphenol in which the alkyl group contains from 1 to 3 carbon atoms, the alkylphenol being at least one member selected from the group consisting of cresols, xylenols, methylethylphenols, and propylphenols which have a boiling point of from 180° to 250° C., the hydrocarbon mixture containing at least 50% by weight of a polycyclic aromatic hydrocarbon and its alkyl derivative, the polycyclic aromatic hydrocarbon and its alkyl derivative being tricyclic to pentacyclic aromatic hydrocarbons and their alkyl derivatives and being at least one member selected from the group consisting of phenanthrene, anthracene, fluoranthene, pyrene, chrysene, cholanthrene, benzo (a) phrene, and their alkyl derivatives, wherein at least 80% by weight of the hydrocarbon mixture has a boiling point in a range of from 320° to 550° C., the hydrogenation being carried out in a high temperature and pressure atmosphere in the presence of a catalyst containing a sulfide selected from the group VII metal sulfides and group IV metal sulfides of the Periodic Table to obtain a partially hydrogenated product having a partial hydrogenation of an aromatic ring of the polycyclic aromatic hydrocarbon or its alkyl derivative, the catalyst containing the sulfide is selected from the group consisting of nickel-molybdenum sulfide catalyst and cobalt-molybdenum sulfide catalyst and wherein the hydrogenation in a high temperature and pressure hydrogen atmosphere is performed at a temperature of from 280° to 360° C., a pressure of from 50 to 200 kg/cm$^2$ (gauge pressure), a hydrogen/feed ratio of from 300 to 3,000 vol/vol, and a liquid space velocity per hour of volume of feed oil passing per volume of the catalyst of from 0.5 to 2.0 vol/vol.

* * * * *